US009359113B2

(12) United States Patent
Chen

(10) Patent No.: US 9,359,113 B2
(45) Date of Patent: Jun. 7, 2016

(54) TAMPER-PROOF AND EASY-OPEN SEALING TYPE FOOD CONTAINER

(71) Applicant: Ya-Chien Chen, Taipei (TW)

(72) Inventor: Ya-Chien Chen, Taipei (TW)

( * ) Notice: Subject to any disclaimer, the term of this patent is extended or adjusted under 35 U.S.C. 154(b) by 1 day.

(21) Appl. No.: 14/260,425

(22) Filed: Apr. 24, 2014

(65) Prior Publication Data

US 2015/0307239 A1 Oct. 29, 2015

(51) Int. Cl.
*B65D 43/16* (2006.01)

(52) U.S. Cl.
CPC ..... *B65D 43/162* (2013.01); *B65D 2101/0092* (2013.01)

(58) Field of Classification Search
CPC .... B65D 41/325; B65D 17/163; B65D 43/16; B65D 17/24; B65D 2517/0068; B65D 2543/00833
USPC ..... 220/780, 787, 789, 791, 793, 4.21, 220/4.22, 4.23
See application file for complete search history.

(56) References Cited

U.S. PATENT DOCUMENTS 8,240,505 B1 * 8/2012 Chen ..... B65D 43/162 220/4.21
2015/0060455 A1 * 3/2015 Chou ..... 220/270

* cited by examiner

*Primary Examiner* — Robert J Hicks
*Assistant Examiner* — Kareen Thomas
(74) *Attorney, Agent, or Firm* — Rosenberg, Klein & Lee

(57) ABSTRACT

A tamper-proof and easy-open sealing type food container includes a container body and a lid. A peripheral wall of the container body has at least one recessed wall portion disposed in one corner thereof and formed a retracted external space area and concave camber between the recessed wall portion and a hem. A pull tab extends from outside of a sealing rib that can be inserted into the concave camber. Moreover, there are two tamper-proof structures disposed on the lid. The first is that the first score line has to be poked through, and the second is the second score line needs to be torn off when opening the lid. When either structure is tampered, it could be easily distinguished, which ensures the integrity, safety, and qualities of the food inside the container. With these features plus its sealing effect, the present invention has dual function of tamper-proofing and easy-opening.

5 Claims, 8 Drawing Sheets

TAMPER-PROOF AND EASY-OPEN SEALING TYPE FOOD CONTAINER

BACKGROUND OF THE INVENTION

1. Field of the Invention

The present invention relates to food containers, particularly to a tamper-proof and easy-open sealing type food container, which provides excellent sealing effects and facilitates opening.

2. Description of the Related Art

Plastic containers of box, cup and bowel types made by means of vacuum molding are suitable for keeping food fresh.

For keeping jelly, pudding, cheese or other liquid food, the food container must be well sealed to avoid leakage during delivery or transportation.

The U.S. Pat. No. 6,883,678 discloses a food container sealing structure having a horizontal and vertical dual sealing structure to ensure the sealing integrity of the food container and thus prevent leakage during delivery. The U.S. Pat. No. 6,883,678 is invented by the present inventor. According to this design, the container body has a peripheral coupling flange, and the cover has a peripheral coupling flange coupled to the coupling flange of the container body to seal the container body. The coupling flange of the container body has endless concave portions respectively formed in horizontal section and vertical section thereof. The coupling flange of the cover having endless convex portions respectively formed in both horizontal and vertical section thereof and respectively engaged into the endless concave portions of the container body.

This design achieves excellent sealing effects. However, due to tight sealing, it is difficult to open the lid from the container body. Therefore, the present inventor further invented U.S. Pat. No. 8,240,505, entitled "Easy-open sealing type food container" to improve mentioned problem.

Furthermore, the consumers are gradually paying their attention to whether the food containers were opened and tampered by other people. Thus, the U.S. Pat. Nos. 7,073,680 and 7,118,003 have disclosed a tamper-evident food container. However, there would be a strip left after opening the lid, resulting in inconveniences for users. In other words, there is still room for improvement.

Therefore, it is desirable to provide a food container that facilitates opening with excellent sealing effects as well as tamper-proofing function.

SUMMARY OF THE INVENTION

It is a primary object of the present invention to provide a tamper-proof and easy-open sealing type food container with both excellent sealing effects and tamper-proof function, ensuring the integrity, safety, and qualities of the food inside the container for consumers.

Another object of the present invention is to provide a tamper-proof and easy-open sealing type food container which is convenient for the consumers, leaving no strips after opening.

In order to achieve the objects, the present invention, a tamper-proof and easy-open sealing type food container, includes features as following.

A peripheral wall of a container body has at least one recessed wall portion disposed in one corner thereof and defining a retracted external space area between the recessed wall portion and the hem. The retracted external space area between said recessed wall portion and said hem is arranged at either side of the corner at the rear of the container body; at the rear side of the lid and container body, a flexible hinge is arranged, either side of which is close to said retracted external space area, and the bottom of which is joined to the edge of said hem of the container body while the top of which is joined to the lid with a pre-arranged second score line that could be torn off; the area of said hem does not cover said flexible hinge, forming a C shape protrusive hem with a vertical inner side; said inner side of the protrusive hem and first vertical sealing face have a plane surface in-between in accordance with shapes of said flange edge, making the bottom line of said inner side of the protrusive hem corresponding with a fringe of said flange edge when closing up said plane surface; and the pull tab is joined to said flange edge and also covers said concave camber, disposing the fringe of said concave camber close to the bottom line of said inner side of the protrusive hem, and on the pull tab there is a first score line pre-arranged which provides a retaining lug for fingers to hook into when poking through the pull tab along the score lines;

whereby the lid is sealed on the container body with the pull tab covering the concave camber so as to form the first tamper-proof structure, and the flexible hinge at the rear side of said lid and said container body is the second one as the pull tab has to be poked through along the first score line when opening the lid, and then a finger has to hook into the retaining lug upwardly to tear off the second score line of the flexible hinge joined to the pull tab so that the lid could be totally removed from the container body.

With features disclosed above, the lid seals the container body tightly and provides a human friendly operating interface, enabling users to conveniently open the food container with less effort. Besides, there are two tamper-proof structures disposed on the lid. The first is that the first score line has to be poked through when opening the lid, since there is a bottom line of the inner side of the protrusive hem corresponding with the fringe of said flange edge. The second is that the second score line needs to be torn off when opening the lid. When either structure is tampered, it could be easily distinguished, which ensures the integrity, safety, and qualities of the food inside the container. With aforesaid features plus its sealing effect, the present invention has dual function of tamper-proofing and easy-opening.

DETAILED DESCRIPTION OF THE PREFERRED EMBODIMENT

Figure 1:
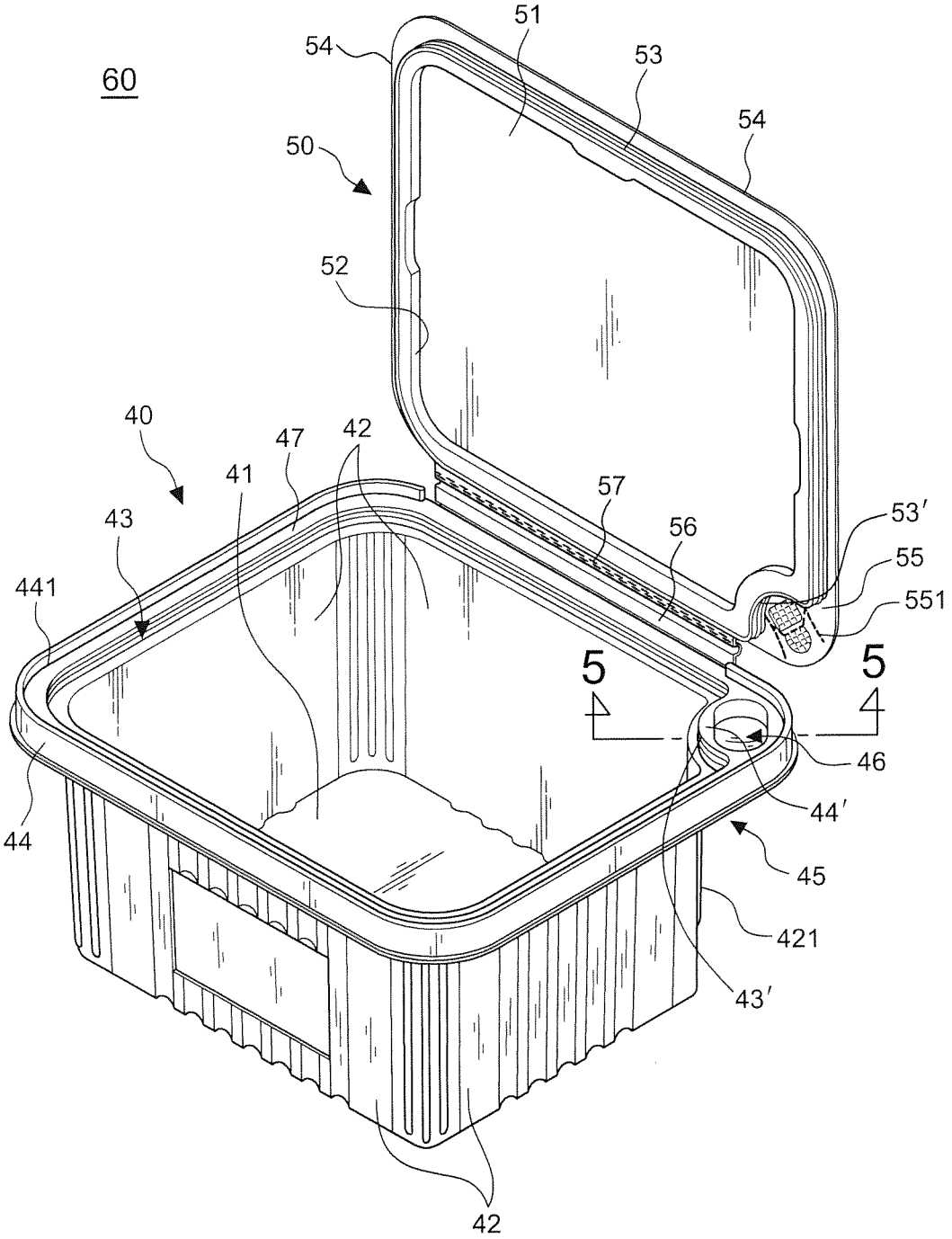
FIG. 1 is a perspective view of the present invention with the lid open.

Referring to FIGS. 1-10, a tamper-proof and easy-open sealing type food container 60 in accordance with the invention includes a container body 40 and a lid 50.

With reference to FIGS. 1-6, the container body 40 comprises a bottom wall 41, a peripheral wall 42 upwardly extended from the border of the bottom wall 41, and a first sealing rib 43 extending along the border of a top edge of the peripheral wall 42. The first sealing rib 43 comprises a first vertical sealing face 43*b* upwardly extended from a first horizontal sealing face 43*a* and a hem 44 outwardly extended from the first vertical sealing face 43*b*.

With reference to FIGS. 1-7, the lid 50 comprises a top wall 51 and a rim 52 downwardly extended from the top wall 51 along the border of the top wall 51 and a second sealing rib 53 extending around the rim 52 to fit the first sealing rib 43. The second sealing rib 53 comprises a second horizontal sealing face 53*a* for abutting against the first horizontal sealing face 43*a*, a second vertical sealing face 53*b* for abutting against the first vertical sealing face 43*b* and a flange edge 54 outwardly extending from the second vertical sealing face 53*b*.

Figure 2:
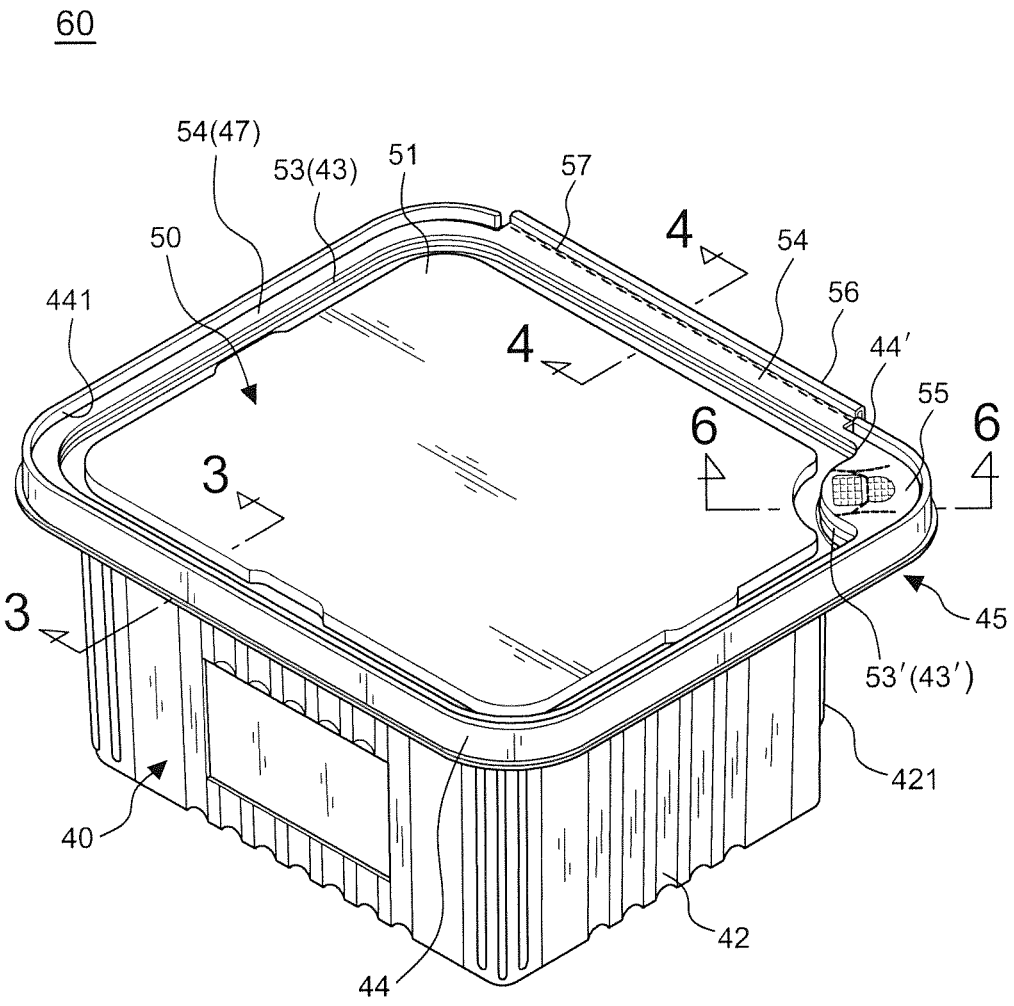
FIG. 2 is a perspective view of the present invention with the lid sealed.
Figure 3:
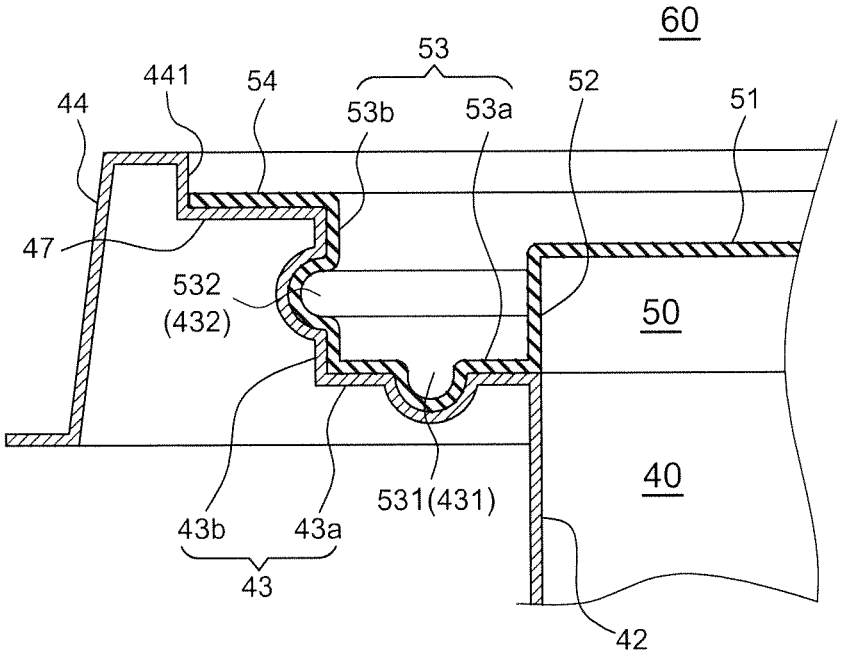
FIG. 3 is a cross-section view along line 3-3 in FIG. 2.
Figure 4:
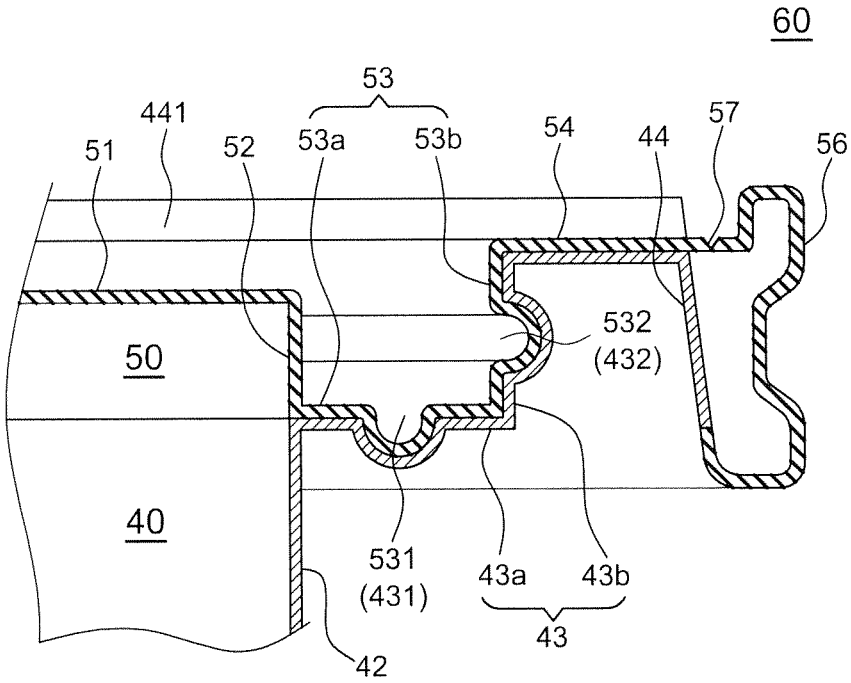
FIG. 4 is a cross-section view along line 4-4 in FIG. 2.
Figure 5:
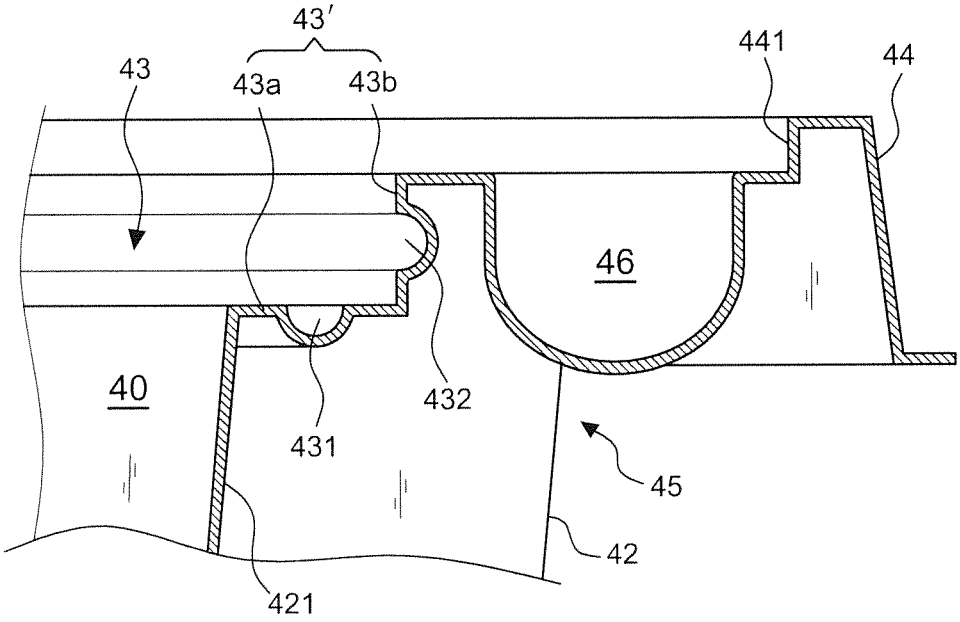
FIG. 5 is a cross-section view along line 5-5 in FIG. 1.
Figure 6:
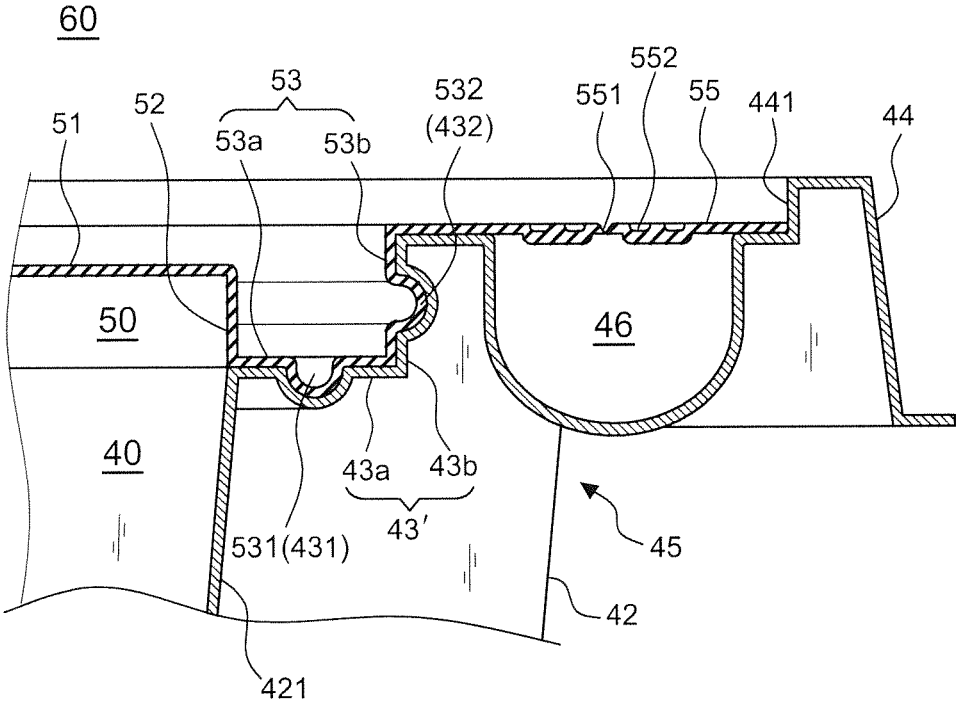
FIG. 6 is a cross-section view along line 6-6 in FIG. 2.
Figure 7:
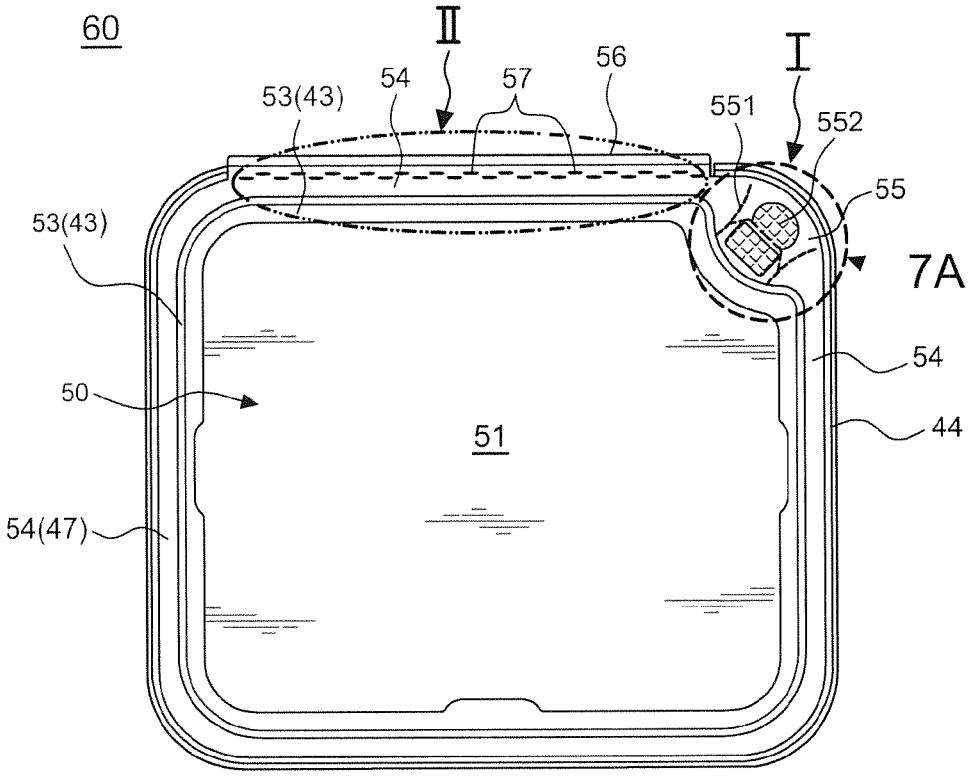
FIG. 7 is a top plan view of FIG. 2.

Referring to FIGS. 1 and 2, the peripheral wall 42 of the container body 40 has at least one recessed wall portion 421 disposed in one corner thereof and defined a retracted external space area 45 between the recessed wall portion 421 and the hem 44. A recessed third sealing rib 43' extended from the first sealing rib 43. A lip 44' as shown in FIG. 7 disposed at an outer side relative to the recessed third sealing rib 43' and a concave camber 46 formed between the lip 44' and the hem 44. The lid 50 comprises a fourth sealing rib extended 53' from the second sealing rib 53 for abutment against the third sealing rib 43' of the lid 50 and a pull tab 55 extended from an outer side of the fourth sealing rib 53' and inserting into above said concave camber 46.

Further referring to FIGS. 1, 5, 6, and 9, the tamper-proof and easy-open sealing type food container 60 in accordance with the present invention has the container body 40 defining the retracted external space area 45 and the concave camber 46 at the top side of the retracted external space area 45. Thus, the retracted external space area 45 and the concave camber 46 constitute an operating space convenient for the operation of the both hands to open the food container. When opening the lid 50, the retracted external space area 45 provides a space for the user to hold the easy-open sealing type food container 60 by the fingers of one hand and fingers of another hand holding the pull tab 55 in the concave camber 46 in order to easily open the lid 40 from the container body 50.

In a preferred embodiment, a lip 44' disposed at an outer side relative to the recessed third sealing rib 43' and a concave camber 46 formed between the lip 44' and the hem 44.

In this embodiment, the container body 40 further comprises a first sealing groove 431 surrounded by the first sealing rib 43 and the third sealing rib 43', and a second sealing groove 432 extending along the first vertical sealing face 43*b*. Further, the lid 50 comprises a first engagement protrusion 531 extending along the second horizontal sealing face 53*a* and adapted for engaging the first sealing groove 431, and a second engagement protrusion 532 adapted for engaging the second sealing groove 432. By means of aforesaid structure, the lid 50 of the present invention is fit for sealing and has improvements in the method of opening the lid 50.

Furthermore, the retracted external space area 45 formed between the recessed wall portion 421 and the hem 44 could be arranged at either side of the corner at the rear of the container body 40. In this preferred embodiment, the retracted external space area 45 is arranged at the right corner of the rear of the container body 40, but the present invention is not limited to such arrangement.

Also, at the rear side of the lid 50 and the container body 40, a flexible hinge 56 is arranged, either side of which is close to the retracted external space area 45, and the bottom of which is joined to the edge of the hem 44 of the container body 40 while the top of which is joined to the lid 50 with a pre-arranged second score line 57 that could be torn off. On the other hand, the area of the hem 44 does not cover the flexible hinge 56, forming a C shape protrusive hem with a vertical inner side 441; said inner side 441 of the protrusive hem and the first vertical sealing face 43*b* have a plane surface 47 in-between in accordance with shapes of said flange edge 54, making the bottom line of said inner side 441 of the protrusive hem corresponding with a fringe of said flange edge 54 when closing up said plane surface 47. In addition, the pull tab 55 is joined to the flange edge 54 and also covers the concave camber 46, disposing the fringe of said concave camber 46 close to the bottom line of the inner side 441 of the protrusive hem, and on the pull tab 55 there is a first score line 551 pre-arranged which provides a retaining lug 55' for fingers to hook into when poking through the pull tab along the score lines.

In this preferred embodiment, the first score line 551 of said pull tab 55 is arranged in an H shape, and the pull tab 55 could have a coarse surface 552.

Figure 7A:
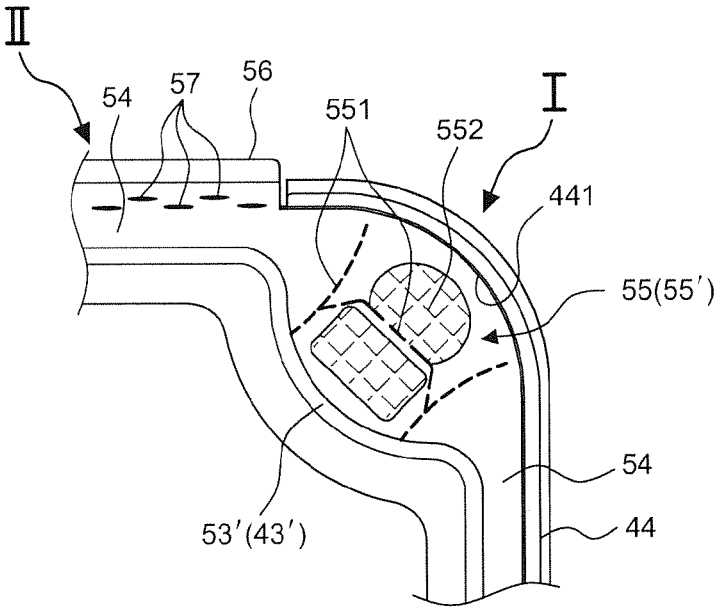
FIG. 7A is a partially enlarged schematic view of FIG. 7.

As shown in FIG. 7A, the lid 50 is sealed on the container body 40 with the pull tab 55 covering the concave camber 46 so as to form the first tamper-proof structure (I), and the flexible hinge 56 at the rear side of said lid 50 and said container body 40 is the second one (II) as the pull tab 55 has to be poked through along the first score line 551 when opening the lid 50, and then a finger has to hook into the retaining lug 55' upwardly to tear off the second score line 57 of the flexible hinge 56 joined to the pull tab 55 so that the lid 50 could be totally removed from the container body 40.

In a preferred embodiment, the second score line 57 of said flexible hinge 56 is connected to the fringe line of the pull tab 55. When the pull tab 55 is hooked upwardly from said concave camber 46, the second score line 57 is torn off by the shear stress as well.

Figure 8:
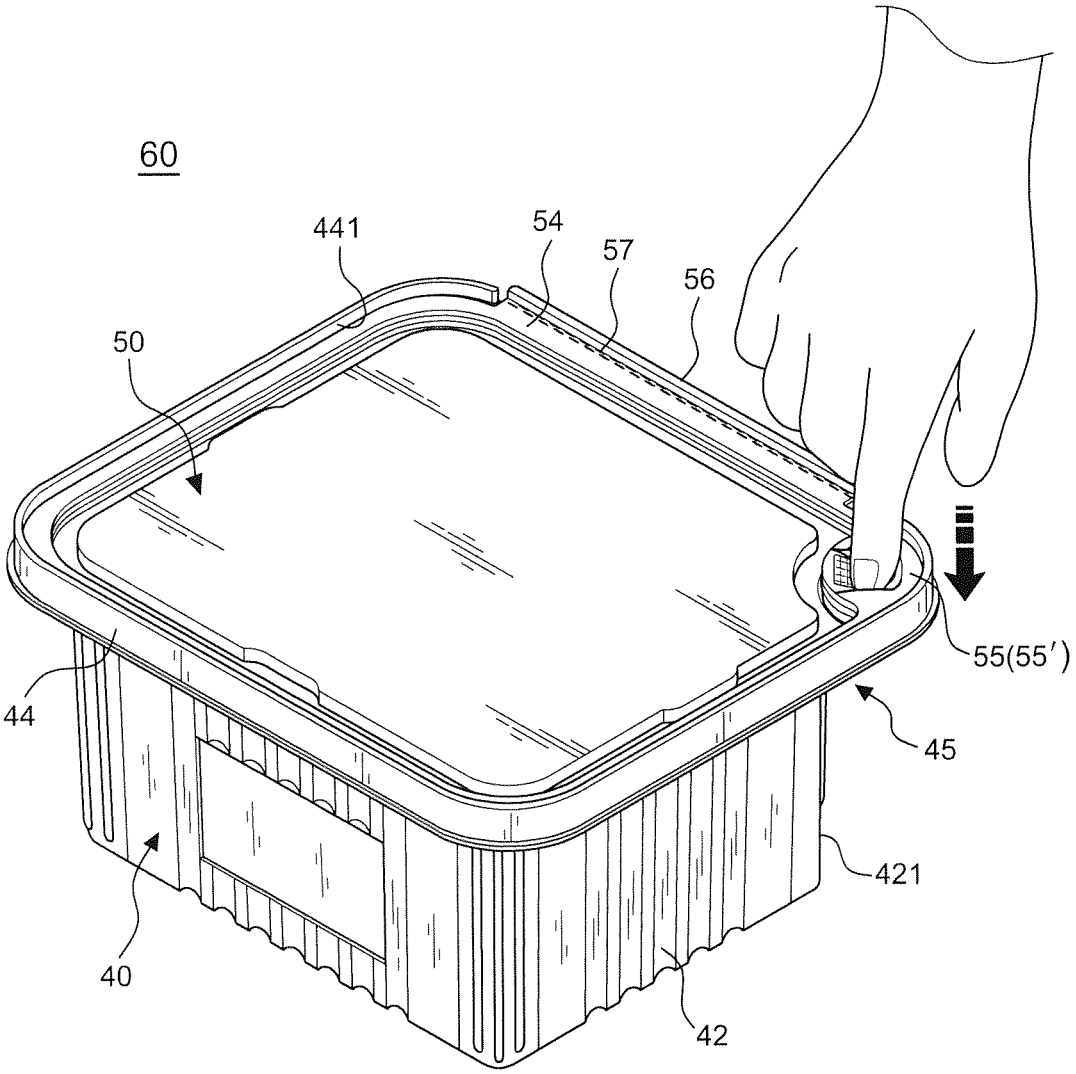
FIG. 8 is a practical application view of the present invention illustrating the first tamper-proof structure.
Figure 9:
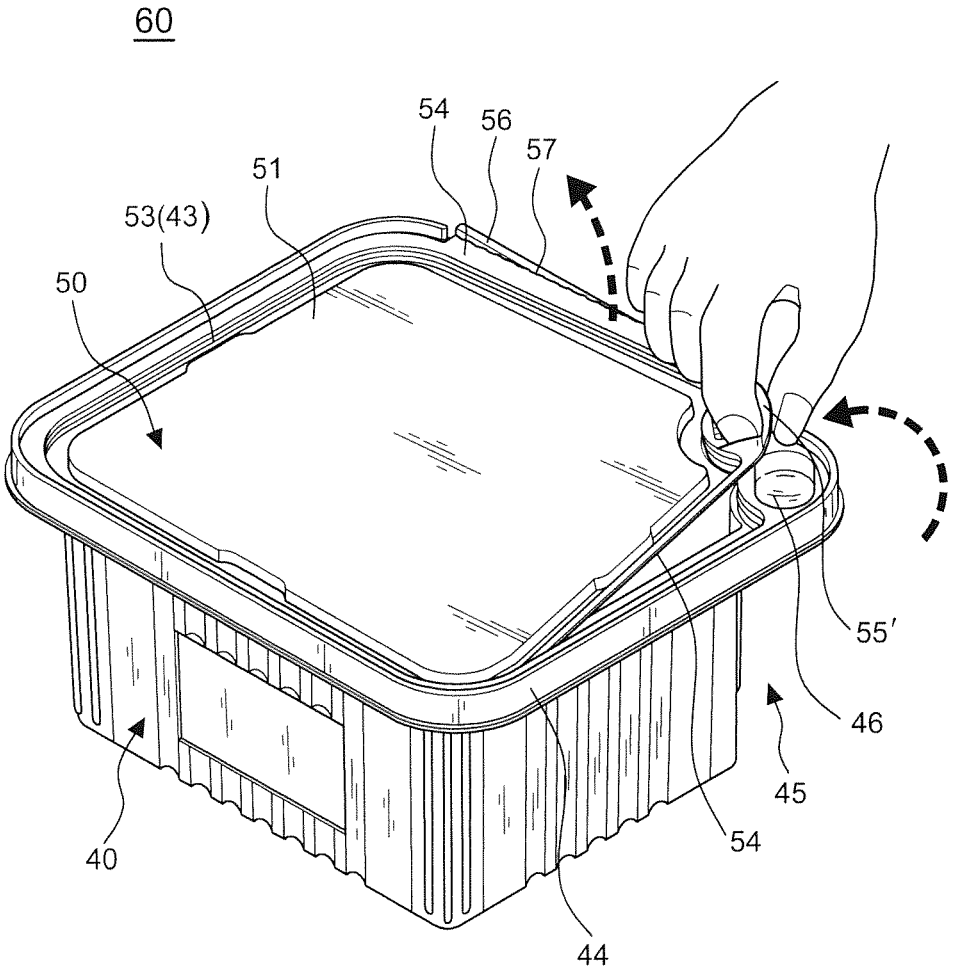
FIG. 9 is a practical application view of the present invention illustrating the second tamper-proof structure.
Figure 10:
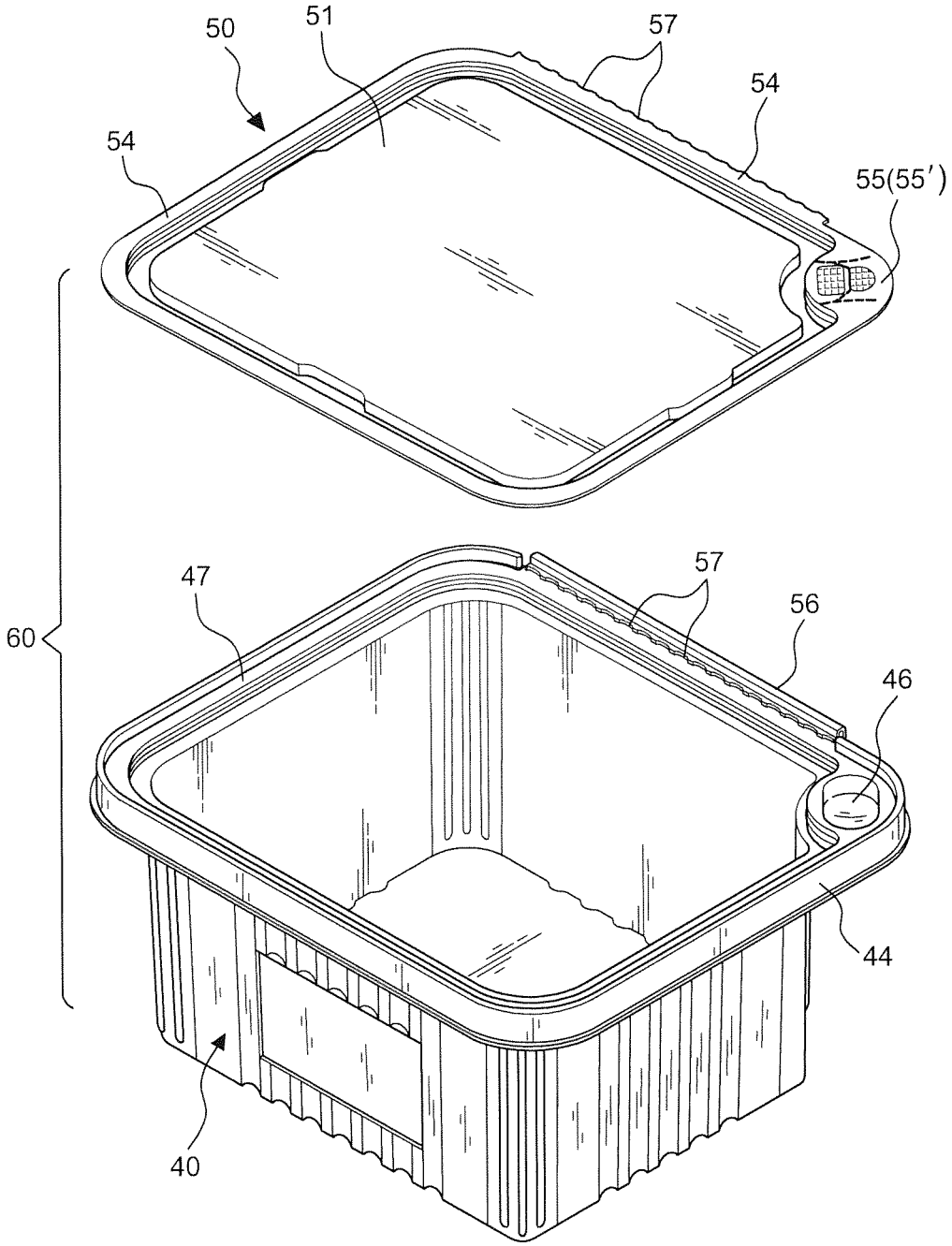
FIG. 10 is a practical application view of the present invention with the lid removed from the container body.

Referring to FIGS. 8-10, the invention provides a tamper-proof and easy-open sealing type food container 60 which provides an operating space around one corner thereof to facilitate the operation of the fingers in lifting the lid 50 from the container body 40 to disengage the fourth sealing rib 53' at the lid 50 from the third sealing rib 43' at the container body 40 with less effort. When the lid 50 is closed on the container body 40, the fourth sealing rib 53' at the lid 50 is sealed with the third sealing rib 43' at the container body 40, keeping the sealing type food container 60 well enclosed and therefore avoiding leakage. Moreover, there are two tamper-proof structures disposed on the lid 50. The first structure is that the first score line 551 has to be poked through when opening the lid 50, since there is a bottom line of the inner side 441 of the protrusive hem corresponding with the fringe of said flange edge 54. The second is that the second score line 57 needs to be torn off when opening the lid 50. When either structure is tampered, it could be easily distinguished, which ensures the integrity, safety, and high qualities of the food inside the container. With aforesaid features plus its sealing effect, the present invention has dual function of tamper-proofing and easy-opening.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A tamper-proof and easy-open sealing food container, comprising a container body comprising a bottom wall, a peripheral wall upwardly extended from a border of said bottom wall, and a first sealing rib extending along a border of a top edge of said peripheral wall, said first sealing rib comprising a first horizontal sealing face, a first vertical sealing face upwardly extended from said first horizontal sealing face and a hem outwardly extended from said first vertical sealing face;

a lid comprising a top wall and a rim downwardly extended from said top wall along a border thereof and a second sealing rib extending around said rim to fit said first sealing rib, said second sealing rib comprising a second horizontal sealing face for abutting against said first horizontal sealing face, a second vertical sealing face for abutting against said first vertical sealing face and a flange edge outwardly extending from said second vertical sealing face;

said peripheral wall of said container body has at least one recessed wall portion disposed in one corner thereof and defining a retracted external space area between said recessed wall portion and said hem, a recessed third sealing rib extended from said first sealing rib, a lip disposed at an outer side relative to said recessed third sealing rib and a concave camber formed between said lip and said hem;

said lid comprises a fourth sealing rib extended from said second sealing rib for abutment against said third sealing rib rim of said lid and a pull tab extended from an outer side of said fourth sealing rib and inserting into said concave camber;

wherein said retracted external space area between said recessed wall portion and said hem is arranged at either side of the corner at a rear of the container body;

at a rear side of said lid and said rear side of said container body, a flexible hinge is arranged, either side of which is close to said retracted external space area, and a bottom of said hinge is joined to an edge of said hem of the container body while a top of said hinge is joined to the lid with a pre-arranged second score line that could be torn off;

an area of said hem does not cover said flexible hinge, forming a C shape protrusive hem with a vertical inner side, said inner side of the protrusive hem and first vertical sealing face have a plane surface in-between in accordance with shapes of said flange edge, making a bottom line of said inner side of the protrusive hem corresponding with a fringe of said flange edge when closing up said plane surface, said C shape protrusive hem extending vertically above said flange edge about a perimeter of said container body wherein a gap of said C shape protrusive hem is located at said flexible hinge; and said pull tab is joined to said flange edge and also covers said concave camber, disposing a fringe of said concave camber close to the bottom line of said inner side of the protrusive hem, and on the pull tab there is a first score line pre-arranged which provides a retaining lug for fingers to hook into when poking through the pull tab along the score lines;

whereby the lid is sealed on said container body with the pull tab covering said concave camber so as to form a first tamper-proof structure, and the flexible hinge at the rear side of said lid and said container body is a second tamper-proof structure as the pull tab has to be poked through along the first score line when opening the lid, and then a finger has to hook into the retaining lug upwardly to tear off the second score line of the flexible hinge joined to the pull tab so that the lid could be totally removed from the container body.

2. The tamper-proof and easy-open sealing food container as claimed in claim 1, wherein said container body further comprises a first sealing groove surrounded by said first sealing rib and said third sealing rib, and a second sealing groove extending along said first vertical sealing face; said lid comprises a first engagement protrusion extending along said second horizontal sealing face and adapted for engaging said first sealing groove, and a second engagement protrusion adapted for engaging said second sealing groove.

3. The tamper-proof and easy-open sealing food container as claimed in claim 1, wherein the first score line of said pull tab is arranged in an H shape.

4. The tamper-proof and easy-open sealing food container as claimed in claim 1, wherein said pull tab has a coarse surface.

5. The tamper-proof and easy-open sealing food container as claimed in claim 1, wherein the second score line of said flexible hinge is connected to a fringe line of said pull tab whereupon the pull tab is hooked upwardly from said concave camber, the second score line is torn off by a shear stress as well.

* * * * *